US005992160A

United States Patent [19]

Bussjager et al.

[11] Patent Number: 5,992,160

[45] Date of Patent: Nov. 30, 1999

[54] MAKE-UP AIR ENERGY RECOVERY VENTILATOR

[75] Inventors: Ruddy C. Bussjager, Chittenango; Lester N. Miller, East Syracuse; James M. McKallip, Pompey, all of N.Y.

[73] Assignee: Carrier Corporation, Syracuse, N.Y.

[21] Appl. No.: 09/075,556

[22] Filed: May 11, 1998

[51] Int. Cl.[6] ..... F25B 7/00

[52] U.S. Cl. ..... 62/79; 62/99; 62/427

[58] Field of Search ..... 62/90, 96, 99, 62/427, 79, 335

[56] References Cited

U.S. PATENT DOCUMENTS

| | | | |
|---|---|---|---|
| 3,949,810 | 4/1976 | Cobb | 165/216 |
| 3,995,809 | 12/1976 | Karlsson | 237/2 B |
| 4,281,522 | 8/1981 | Bussjager . | |
| 4,391,104 | 7/1983 | Wendschlag | 62/79 |
| 5,400,607 | 3/1995 | Cayce | 62/90 |
| 5,551,235 | 9/1996 | Calton et al. . | |
| 5,551,245 | 9/1996 | Calton et al. | 62/90 |
| 5,622,057 | 4/1997 | Bussjager et al. | 62/173 |
| 5,729,993 | 3/1998 | Boiarski et al. | 62/175 |

*Primary Examiner*—William Doerrler

[57] ABSTRACT

In an air conditioning system designed to operate in relatively high humidity conditions, an auxiliary unit, including a complete and independent operating refrigerant circuit, is installed in air flow relationship therewith such that outdoor make-up air is caused to flow first through an auxiliary evaporator coil then through the system evaporator coil, and at least a portion of the return air is passed through an auxiliary condenser coil before being discharged outside. Energy is thereby recovered from the return air, and the make-up air is pre-conditioned to improve the dehumidifying effect of the system.

11 Claims, 3 Drawing Sheets

MAKE-UP AIR ENERGY RECOVERY VENTILATOR

BACKGROUND OF THE INVENTION

This invention relates generally to air conditioning systems and, more particularly, to an improved method and apparatus for controlling the humidity in a space.

With conventional air conditioning systems, little effort is made to control the humidity in the space being cooled and, as a result, in order to achieve the degree of desired comfort, it is necessary to bring the space down to a lower temperature than would otherwise be required. Such an "over cooling" function is relatively expensive and also may be cause for discomfort to one in the space being cooled.

An improvement was made to the conventional air conditioning system by the addition of a subcooler on the downstream side of the evaporator as shown and described in U.S. Pat. No. 5,622,057, issued on Apr. 22, 1997. Here, the latent effect of the evaporator coil is enhanced by the added subcooler coil, and the humidity is substantially reduced.

Another approach that has been taken to control humidity in a space is that of using desiccants to supplement the conventional air conditioning system. Such a system is shown in U.S. Pat. No. 5,551,245, issued on Sep. 3, 1996. Although such a desiccant system can provide even greater humidity control than that of the subcooler approach mentioned above, the fabrication and installation costs thereof are substantially greater.

Because of the tight construction of buildings erected today, there is now the condition known as the "sick building" syndrome, wherein there is insufficient leakage of outside air into the building such that the same air is recycled over and over and becomes stale and stagnant. To avoid this problem, there is now an ASHRAE standard code establishing prescribed requirements for minimum replenishment of air volumes in public buildings. This is presently being accomplished by the use of economizers, but present systems will not accommodate the use of 100% outside air since the cooling capacity is generally not sufficient to do so. Similarly, a make-up air pre-conditioner is shown in U.S. Pat. No. 4,281,522, wherein a supplementary system is used to pre-cool the outdoor air. Again, such a system is not capable of accommodating 100% outside air It is therefore an object of the present invention to provide an improved method and apparatus for the control of humidity in an air conditioned space.

Another object of the present invention is the provision for ensuring that the air in a building does not become stale.

Yet another object of the present invention is the provision for controlling humidity in an economical and effective manner.

Still another object of the present invention is the provision for the effective and economical use of up to 100% of outside make-up air.

These objects and other features and advantages become more readily apparent upon reference to the following description when taken in conjunction with the appended drawings.

SUMMARY OF THE INVENTION

Briefly, in accordance with one aspect of the invention, a complete refrigeration circuit, including a compressor, a condenser coil, an expansion device, and evaporator coil are installed in working relationship with an air conditioning system having its own such components. The ducting and flow of air by way of fans is arranged such that the outdoor make-up air is made to flow first through the auxiliary evaporator coil and then through the system evaporator coil. Also, at least a portion of the return air from the space is made to pass through the auxiliary condenser coil before it is discharged outside. In this way, the auxiliary system is made to be more efficient by use of the cooler return air rather than outdoor air, and the auxiliary evaporator coil brings the outdoor air closer to the dew point prior to its being passed through the evaporator to thereby increase the amount of condensation that occurs at the evaporator coil such that its latent effect is substantially enhanced lo reduce the humidity of the air being passed to the space.

By another aspect of the invention, filters may be added upstream of both the auxiliary evaporator and the system evaporator coils.

By yet another aspect of the invention, a subcooler coil may be disposed downstream of the system evaporator coil to further enhance the latent cooling effect thereof.

In the drawings as hereinafter described, a preferred embodiment and a modified embodiment are depicted; However, various other modifications and alternate constructions can be made thereto without departing from the true spirit and scope of the invention.

DESCRIPTION OF THE PREFERRED EMBODIMENT

Figure 1:
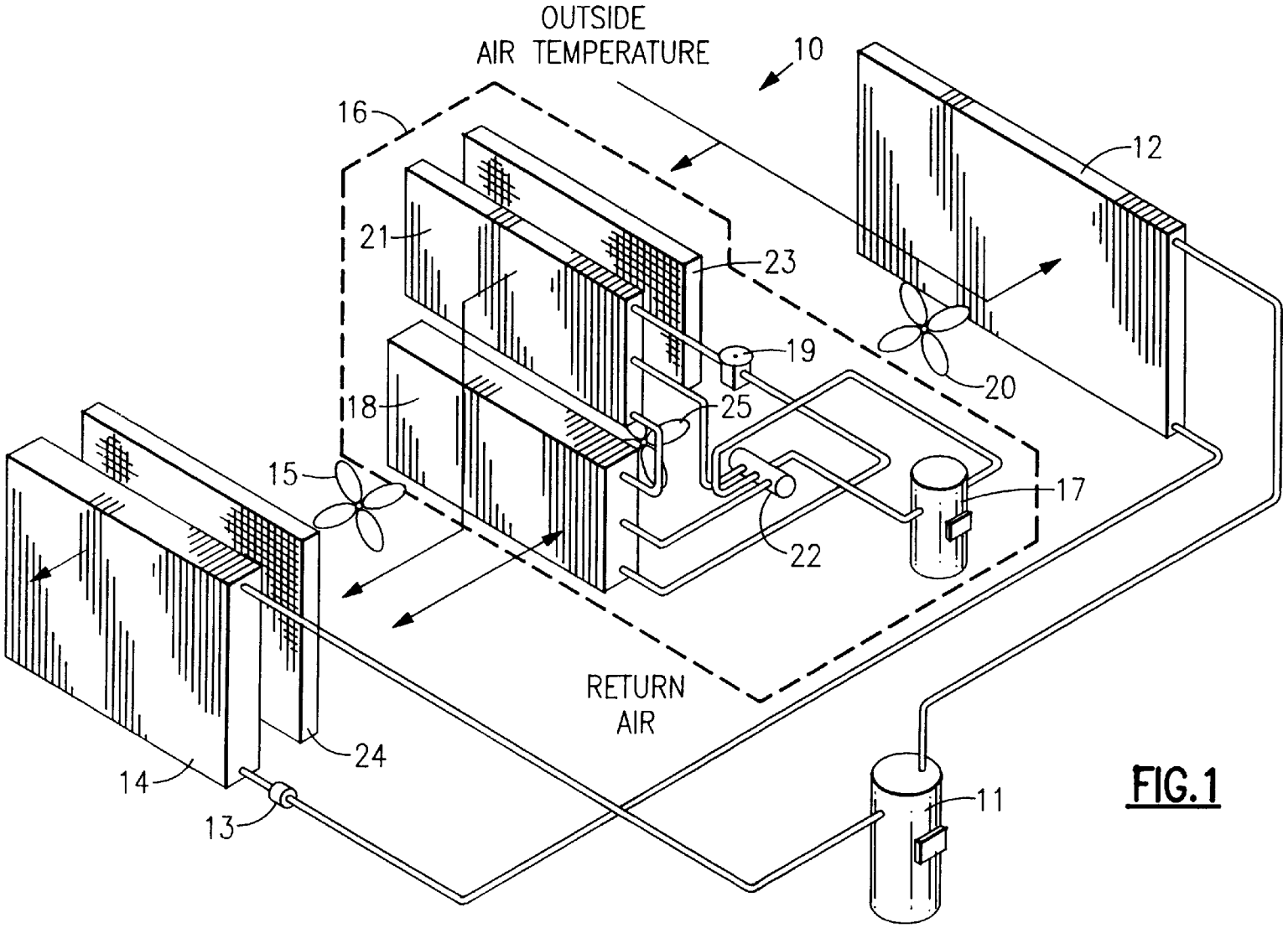
FIG. 1 is a schematic, perspective illustration of an air conditioning system with the present invention incorporated therein.

Referring now to FIG. 1, the invention is shown generally at 10 as applied to an air conditioning system including a compressor 11, a condenser coil 12, an expansion device 13 and an evaporator coil 14 connected in serial flow relationship to operate in a conventional manner, with a fan 15 passing the return air from the space being cooled through the evaporator coil 14, and a fan 20 passing the outdoor air through the condenser coil 12. Although the present invention can be used in a heat pump system, it is most useful in an air conditioning system and will, for purposes of simplicity and description be described in terms of such a system, with the understanding that a reversing valve (not illustrated) could be included such that the system could operate in the heating mode.

In accordance with the present invention, an energy recovery unit or auxiliary system 16 is combined with the conventional air conditioning system in such a way as to operationally interact therewith for the purpose of obtaining improved indoor air quality and comfort.

The auxiliary system 16 includes a compressor 17, a condenser coal 18, an expansion device 19 and an evaporator coil 21. These auxiliary system components are designed to operate in a conventional closed circuit manner to cool the air passing through evaporator coil 21. While the system is primarily designed to operate in the cooling mode, it can also be used as a heat pump to warm the air passing through the coil 21 which is normally considered the evaporator coil but would be a condenser coil when operating in the heat pump mode of operation. For that purpose, a reversing valve 22 is provided to enable the selective change of refrigerant flow so as to allow either cooling or heat pump operation.

Air moving apparatus is provided to move the air through both the auxiliary system and the base system in a manner as shown by the arrows. That is, in one air flow stream, the ambient, outdoor air (make-up air) is caused by the fan. 15 to pass through the auxiliary evaporator coil 21 and then through the base system evaporator coil 14. As the ambient air passes through the auxiliary evaporator coil 21, the air is pre-conditioned by the lowering of its dry bulb temperature, thereby removing some moisture and bringing the air closer to its dew point. This enables the base unit evaporator 14 to become more effective in sensible cooling and removing moisture, thereby resulting in improved indoor air quality and comfort.

If the outdoor air is at a lower temperature than the return air from the space, the reversing valve 22 of the auxiliary unit is switched over to a heat pump mode. Then the coil 21 acts as a condenser coil to thereby heat the air passing therethrough, prior to its passing through the base unit evaporator coil 14.

As will be seen, a filter 23 is preferably provided upstream of the auxiliary evaporator coil 21 to screen out any particulate matter that may be entrained i n the ambient air. Similarly, a filter 24 is preferably placed upstream of the system evaporator coil 14 to filter out any particulate matter that would otherwise pass through that coil.

In addition to the circulation of the ambient air through the system as described hereinabove, there is also an air moving means, such as an electric motor driven fan 25, to circulate the return air through the system as indicated by the arrows. Here, all or a portion of the return air is passed over the condenser coil 18 to complete the condensation stage in the circuit of the auxiliary system. In this way, the system takes advantage of the relatively lower temperature of the return air (e.g 80 DB/67 WB degrees F as compared with a typical 95 DB/75 WB degrees F outdoor temperature) to increase the efficiency of the auxiliary system. After passing through the auxiliary condenser coil 18, the air is then discharged to ambient.

As will be seen in FIG. 1, a portion of the return air may be mixed with the make-up air coming from the evaporator coil 21 prior to being passed through the evaporator coil 14. This mixture may be selectively varied, depending on the ambient conditions and the desired conditions in the space to be cooled, such that the make-up air can be regulated at a fixed percentage within the range of 0–100%.

It will be recognized that where the ambient temperature is lower than the desired temperature in the space, the reversing valve 22 may be switched over to the heat pump mode such that the condenser coil 18 acts as an evaporator coil, and the air passing therethrough is therefore cooled prior to being discharged to the outside.

Figure 2:
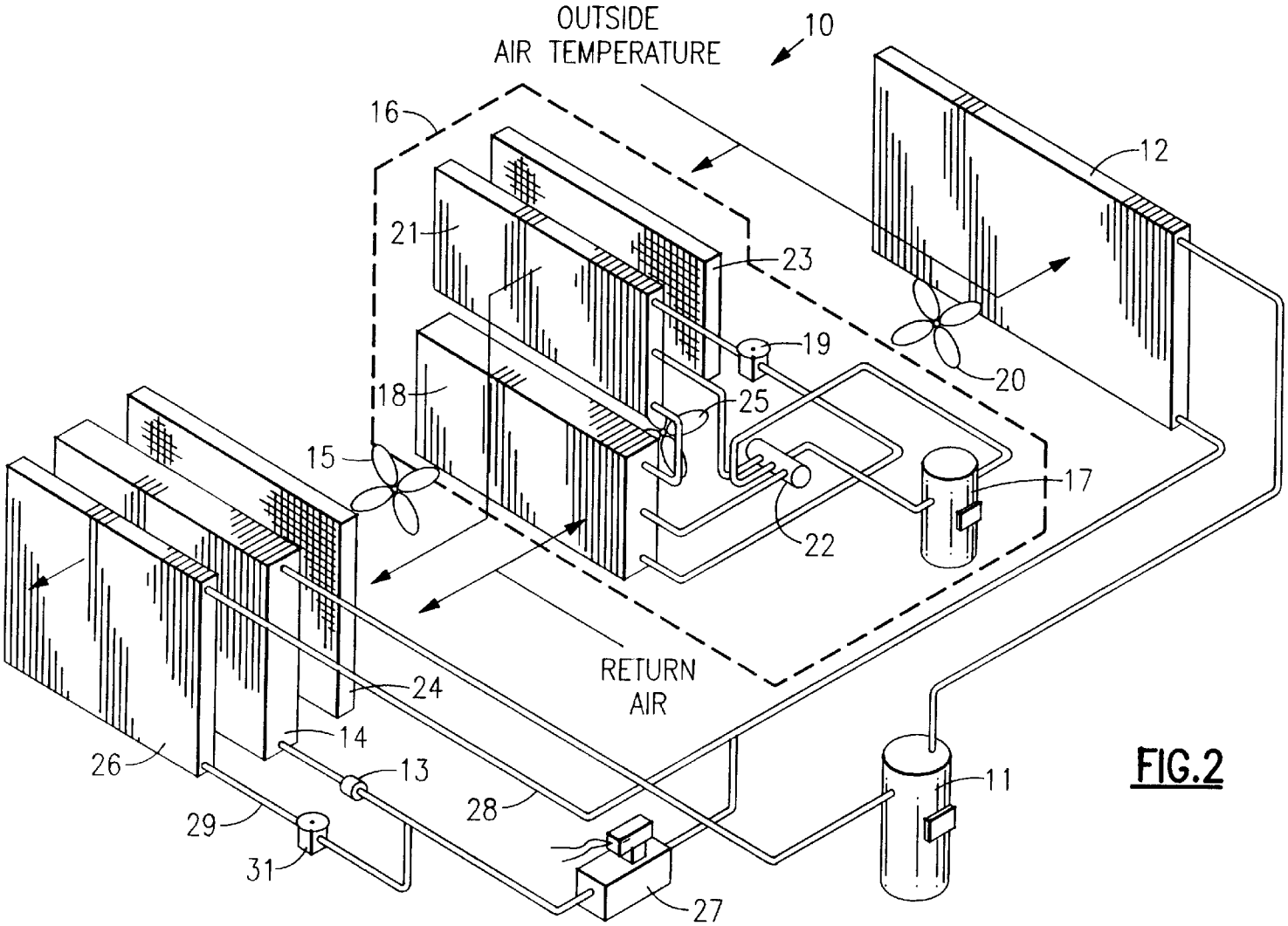
FIG. 2 is a schematic, perspective illustration of an air conditioning system with a modified embodiment of the present invention incorporated therein.

Referring now to FIG. 2, an alternate embodiment of the present invention is disclosed wherein, a subcooler coil 26 is added for the purpose of selectively subcooling the liquid refrigerant prior to its being passed to the evaporator coil 14 in a manner shown in detail in U.S. patent application. Ser. No. 5,622,057 assigned to the assignee of the present invention and incorporated herein by reference. A solenoid valve 27 is provided to allow the selective inclusion or exclusion of the subcooler coil 26 within the circuit. When the solenoid valve 27 is open, the refrigerant passes from the condenser coil 12, through the solenoid valve 27, through the expansion valve 13 and to the evaporator coil 14 in a manner as described hereinabove. When subcooling is desired, the solenoid valve 27 is closed so that the refrigerant passes along line 28 to the subcooler coil 26 where the temperature of the refrigerant is reduced. The cooler refrigerant then passes from the subcooler coil 26 along line 29 to a thermal expansion valve 31, where the pressure of the liquid refrigerant is reduced prior to entering the expansion device 13 and the evaporator coil 14. The thermal expansion valve 31 is controlled in a manner described in the above referenced patent.

Figure 3:
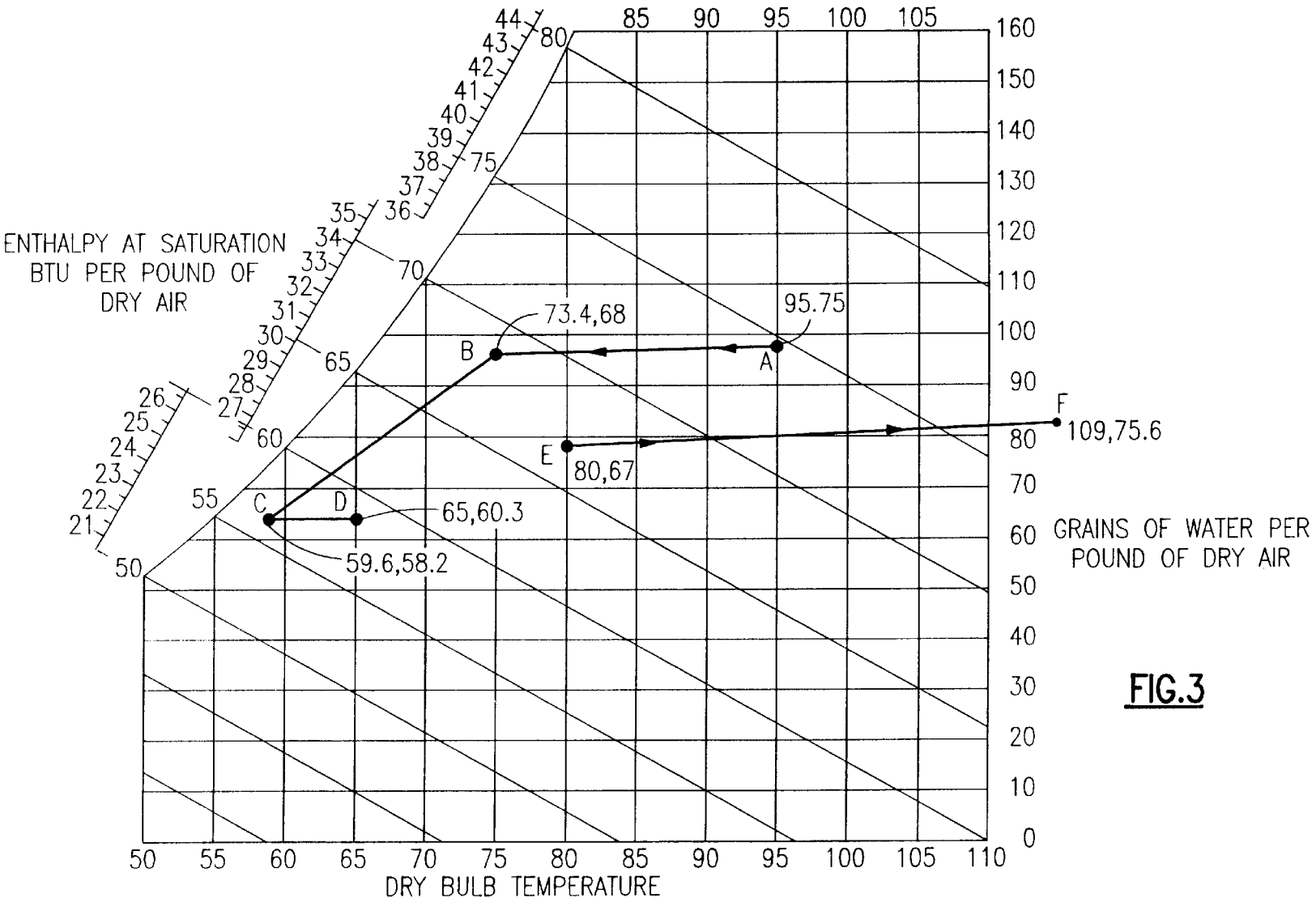
FIG. 3 is a psychrometric chart illustration of the cycles for both the return air and the supply air flowing through the system.

Referring now to FIG. 3, there is shown a psychrometric chart illustration of the temperatures of the various air flows passing through the system on a day when the outdoor temperature is 95° F. Assuming the system is operating with 100% make-up air, ambient air is brought in at 95 DB/75 WB degrees F as shown at A. The air is cooled by the evaporator coil 21 to 73.4 DB/68 WB degrees F as indicated a point B. That air is then caused to pass through the evaporator coil 14 where it is further cooled to 59.6 DB/58.2 WB degrees F as shown at C. At this temperature, which is below the dew point, a substantial amount of condensation occurs to thereby reduce the humidity of the air being passed to the spaced being cooled. This condensate is drained off in a conventional manner. The cooled air is then passed through the subcooler 26, where it picks up heat from the refrigerant being pre-cooled, with a resulting air temperature of 65 DB/60.3 WB degrees F for delivery to the space being cooled.

On the return air side, air coming from the space being cooled is at 80 DB/67 WB degrees F as shown at E in FIG. 3. All of this air is then passed through the condenser coil 18, where it is applied to cool the refrigerant in the auxiliary unit 16 for the purpose of condensing it into a liquid. In the process, the air is heated to 109 DB/75.6 WB degrees F, and this relatively hot air is then discharged to the outside. It will therefore be recognized that the energy of the return air is recovered by the auxiliary unit 16 for the purpose of cooling the ambient air to a temperature level below the return air coming from the space.

While the invention has been described with reference to certain preferred embodiments, it should be recognized that the invention is not limited to the those precise embodiments. Rather, many modifications and variations would present themselves to persons skilled in the art without departing from the scope and spirit of this invention.

What is claimed is:

1. An improved air conditioning system of the type having a compressor, a condenser coil, an expansion device and an evaporator coil connected in serial flow refrigerant circuitry with the system evaporator being adapted for conditioning air coming from and being returned to a space to be conditioned, wherein the improvement comprises:

an auxiliary refrigerant circuit comprising an auxiliary compressor, an auxiliary condenser coil, an auxiliary expansion device, an auxiliary evaporator coil and air moving means installed in operating relationship with the air conditioning system such that said air moving means causes;

outdoor air to flow first through said auxiliary evaporator coil and then through the system evaporator coil; and a portion of return air from a space being conditioned, to flow through said auxiliary condenser coil.

2. An improved air conditioning system as set forth in claim 1 wherein said auxiliary circuit includes a filter and wherein the outdoor air is caused to flow first through said filter and then through said auxiliary evaporator coil.

3. An improved air conditioning system as set forth in claim 1 wherein said air conditioning system includes a filter and wherein said portion of air coming from and being returned to the space to be conditioned is caused to flow first through said filter and then through said system evaporator coil.

4. An improved air conditioning system as set forth in claim 1 wherein said air conditioning system includes a filter and wherein the outdoor air is caused to flow first through said auxiliary evaporator coil, then through said filter and then through the system evaporator coil.

5. In an air conditioning system having an evaporator coil, an expansion device, a condenser coil and a compressor serially connected in closed circuit relationship and having air moving means for moving air from the space being conditioned to the system evaporator and then back to the space being conditioned, an energy recovery unit comprising:

an auxiliary expansion device, an auxiliary evaporator coil, an auxiliary compressor and an auxiliary condenser coil serially connected in a closed circuit relationship and disposed in air flow relationship with the air conditioning system so that said air moving means causes:

at least a portion of the return air to pass through said auxiliary condenser; and outside air to pass first through said auxiliary evaporator and then through the system evaporator.

6. An energy recovery unit as set forth in claim 5 and including a subcooler coil disposed downstream of the system evaporator coil such that said air moving means causes the air passing through the evaporator coil to also pass through the subcooler coil.

7. An energy recovery unit as set forth in claim 5 wherein the air that is passed through said auxiliary condenser coil is subsequently caused to pass through said system condenser coil.

8. An energy recovery unit as set forth in claim 5 and including a reversing valve for selectively converting the energy recovery unit from a cooling unit to a heat pump unit whereby the functions of the auxiliary evaporator coil and the auxiliary condenser coil are reversed.

9. A method of improving the performance of an air conditioning system of the type having an evaporator coil for conditioning air coming from and being returned to a space to be conditioned and a condenser coil comprising the steps of:

installing an auxiliary refrigerant circuit having an auxiliary compressor, an auxiliary condenser coil, an auxiliary expansion device, and an auxiliary evaporator coil;

installing air moving means to cause outdoor air to flow first through said auxiliary evaporator coil and then through the system evaporator coil; and installing air moving means to cause a portion of return air from the space being conditioned, to flow through said auxiliary condenser coil.

10. An improved air conditioning system as set forth in claim 1 wherein the system condenser coil is adapted to have outside air passing therethrough.

11. An air conditioning system as set forth in claim 5 wherein said air moving means moves outside air through said system condenser coil.

* * * * *